US010812919B2

(12) United States Patent
Hillbratt et al.

(10) Patent No.: US 10,812,919 B2
(45) Date of Patent: Oct. 20, 2020

(54) FILTERING WELL-DEFINED FEEDBACK FROM A HARD-COUPLED VIBRATING TRANSDUCER

(71) Applicant: Cochlear Limited, Macquarie University, NSW (AU)

(72) Inventors: Martin Hillbratt, Vastra Gotaland (SE); Marcus Andersson, Gothenburg (DE); Kristian Asnes, Molndal (SE)

(73) Assignee: Cochlear Limited, Macquarie University, NSW (AU)

( * ) Notice: Subject to any disclaimer, the term of this patent is extended or adjusted under 35 U.S.C. 154(b) by 1299 days.

(21) Appl. No.: 14/211,576

(22) Filed: Mar. 14, 2014

(65) Prior Publication Data

US 2014/0288357 A1 Sep. 25, 2014

Related U.S. Application Data

(60) Provisional application No. 61/788,558, filed on Mar. 15, 2013.

(51) Int. Cl.
*H04R 25/00* (2006.01)

(52) U.S. Cl.
CPC ..... *H04R 25/606* (2013.01); *H04R 25/453* (2013.01); *H04R 2460/13* (2013.01)

(58) Field of Classification Search
CPC ..... H04R 25/00; H04R 25/02; H04R 25/45; H04R 25/453; H04R 25/48; H04R 25/60; H04R 25/604; H04R 25/606; H04R 3/002; H04R 3/02
USPC ..... 381/315–331, 151, 380; 600/25
See application file for complete search history.

(56) References Cited

U.S. PATENT DOCUMENTS 6,387,039 B1 * 5/2002 Moses ..... H04R 25/606 600/25
7,720,245 B2 5/2010 Bauman et al.
7,965,853 B2 6/2011 Gao et al.
(Continued)

FOREIGN PATENT DOCUMENTS

JP 2007-051395 A 3/2007
WO 2010/111519 A1 9/2010
(Continued)

OTHER PUBLICATIONS

International Search Report for PCT/IB2014/059843 dated Jul. 30, 2014.
(Continued)

*Primary Examiner* — Ahmad F. Matar
*Assistant Examiner* — Sabrina Diaz
(74) *Attorney, Agent, or Firm* — Pilloff Passino & Cosenza LLP; Martin J. Cosenza

(57) ABSTRACT

Systems and methods are disclosed for a hearing prosthesis, and more particularly to a hearing prosthesis with a rigidly coupled vibrating transducer. In embodiments, the mechanical stimulating hearing prosthesis comprises, for example, at least one sound input device configured to sense a sound signal, and a transducer configured to generate a vibration based on the sound, wherein the sound input device is rigidly coupled to the transducer. Systems and methods are also described for reducing a well-defined mechanical feedback generated by a transducer in a hearing prosthesis.

46 Claims, 9 Drawing Sheets

(56) References Cited

U.S. PATENT DOCUMENTS

2002/0027996 A1* 3/2002 Leedom ..... H04R 25/608 381/322
2002/0122563 A1 9/2002 Schumaier
2004/0120535 A1* 6/2004 Woods ..... H04R 3/007 381/96
2005/0226447 A1* 10/2005 Miller, III ..... H04R 25/453 381/318
2008/0212816 A1* 9/2008 Pedersen ..... H04R 25/453 381/318
2009/0074220 A1 3/2009 Shennib
2009/0138062 A1 5/2009 Balslev
2009/0252361 A1* 10/2009 van Halteren ..... H04R 25/00 381/328
2010/0166198 A1* 7/2010 Perman ..... H04R 25/453 381/60
2010/0329493 A1 12/2010 Arndt et al.
2011/0188686 A1* 8/2011 Munk ..... H04R 25/453 381/318
2012/0029267 A1 2/2012 Ball
2012/0195450 A1* 8/2012 Foeh ..... H04R 25/453 381/318
2012/0302823 A1* 11/2012 Andersson ..... H04R 25/606 600/25
2013/0188796 A1* 7/2013 Kristensen ..... H04R 25/453 381/60

FOREIGN PATENT DOCUMENTS

WO WO 2012/14081 A1 * 10/2012 ..... H04R 25/00
WO WO-2012140818 A1 * 10/2012 ..... G10L 21/0208

OTHER PUBLICATIONS

Ann Spriet, Adaptive Filtering Techniques for Noise Reduction and Acoustic Feedback Cancellation in Hearing Aids, Ph.D. Thesis, 2004.
Supplementary European Search Report for EP 14764706, dated Oct. 7, 2016.

* cited by examiner

FILTERING WELL-DEFINED FEEDBACK FROM A HARD-COUPLED VIBRATING TRANSDUCER

CROSS-REFERENCE TO RELATED APPLICATIONS

This patent application claims priority to U.S. Provisional Patent Application No. 61/788,558, by the same title as that in caption above, filed in the USPTO on Mar. 15, 2013, naming Martin Hillbratt as an inventor, the entire contents of that application being incorporated by reference herein in its entirety.

BACKGROUND

Field of the Technology

The present technology relates generally to hearing prostheses, and more particularly, to filtering feedback from a hard-coupled vibrating transducer.

Related Art

Hearing loss, which may be due to many different causes, is generally of two types, conductive and sensorineural. Sensorineural hearing loss occurs when there is damage to the inner ear, or to the nerve pathways from the inner ear to the brain. Individuals suffering from conductive hearing loss typically have some form of residual hearing because the hair cells in the cochlea are undamaged. As a result, individuals suffering from conductive hearing loss typically receive a prosthetic hearing device that generates mechanical motion of the cochlea fluid. For example, acoustic energy may be delivered through a column of air to the tympanic membrane (eardrum) via a hearing aid residing in the ear canal. Mechanical energy may be delivered via the physical coupling of a mechanical transducer (i.e. a transducer that converts electrical signals to mechanical motion) to the tympanic membrane, the skull, the ossicular chain, the round or oval window of the cochlea or other structure that will result in the delivery of mechanical energy to the hydromechanical system of the cochlea.

Individuals suffering from conductive hearing loss typically receive an acoustic hearing aid, referred to as a hearing aid herein. Unfortunately, not all individuals who suffer from conductive hearing loss are able to derive suitable benefit from hearing aids. For example, some individuals are prone to chronic inflammation or infection of the ear canal thereby eliminating hearing aids as a potential solution. Other individuals have malformed or absent outer ear and/or ear canals resulting from a birth defect, or as a result of medical conditions such as Treacher Collins syndrome or Microtia. Furthermore, hearing aids are typically unsuitable for individuals who suffer from single-sided deafness (total hearing loss only in one ear). Hearing aids commonly referred to as "cross aids" have been developed for single sided deaf individuals. These devices receive the sound from the deaf side with one hearing aid and present this signal (either via a direct electrical connection or wirelessly) to a hearing aid which is worn on the opposite side. Unfortunately, this requires the recipient to wear two hearing aids. Additionally, in order to prevent acoustic feedback problems, hearing aids generally require that the ear canal be plugged, resulting in unnecessary pressure, discomfort, or other problems such as eczema.

As noted, hearing aids rely primarily on the principles of air conduction. However, other types of devices commonly referred to as bone conducting hearing aids or bone conduction devices, function by converting a received sound into a mechanical force. This force is transferred through the bones of the skull to the cochlea and causes motion of the cochlea fluid. Hair cells inside the cochlea are responsive to this motion of the cochlea fluid and generate nerve impulses which result in the perception of the received sound. Bone conduction devices have been found suitable to treat a variety of types of hearing loss and may be suitable for individuals who cannot derive sufficient benefit from acoustic hearing aids, cochlear implants, etc., or for individuals who suffer from stuttering problems.

SUMMARY

In one aspect, there is provided a stimulating hearing prosthesis, comprising: at least one sound input device configured to sense a sound signal; and a transducer configured to generate a vibration based on the sound signal; wherein the sound input device is substantially rigidly coupled or hard coupled to the transducer.

In another aspect, there is provided a hearing prosthesis, comprising: at least one sound input device configured to sense a sound signal; a transducer configured to generate a vibration based on the sound signal; and a signal processor connected to the sound input device and configured to filter well-defined mechanical feedback from the vibration received by the sound input device.

In another aspect, there is provided a method comprising: receiving an acoustic signal with acoustic feedback and mechanical feedback; applying a first modification of the signal to reduce well-defined mechanical feedback from signal; generating a stimulation information based on the modified signal; and generating a mechanical force based on the stimulation information.

According to an exemplary embodiment, there is a hearing prosthesis as detailed herein, wherein an adaptation of the first part of the two part feedback management system by the second part is configured to update less than about once every 160 milliseconds or less than about one every 180 milliseconds.

According to an exemplary embodiment, there is a hearing prosthesis as detailed herein, further comprising a two part feedback management system, wherein a first part of the two part feedback management system is optimized to reduce low frequency feedback.

BRIEF DESCRIPTION OF THE DRAWINGS

Embodiments of the present technology are described below with reference to the attached drawings, in which.

DETAILED DESCRIPTION

Aspects and embodiments of the present technology are directed to a mechanical stimulating hearing prosthesis in which the sound input component and vibrating transducer are rigidly or hard coupled, directly or indirectly. The phrases "rigidly coupled" and "hard coupled," which are used to denote the same feature, mean that the sound input device is intentionally connected to the transducer using a mechanical connection that is stiff, firm, or otherwise substantially inflexible. The mechanical connection can be any mechanical connection such as a direct connection where the sound input device and transducer are coupled without an intervening element, or an indirect connection using a metal shaft, bolt, threaded connection or adhesive connection, or any other coupling mechanism that will produce a mechanical connection. Examples of these connections are detailed further in this specification. Other mechanical connections, not herein disclosed, are also contemplated providing they provide a rigid connection between sound input device and the transducer.

Due to such hard-coupling, the vibration feedback to the sound input device can be accurately defined. The prosthesis also includes a filter configured to substantially remove or compensate for this well-defined vibration feedback. Hearing prostheses that generate mechanical stimulation include, for example, a bone conduction device and a middle ear implant. Aspects of the present technology are described next below with reference to one type of mechanical stimulating hearing prosthesis, namely a bone conduction device. It should be appreciated, however, that embodiments of the present technology may be implemented in other mechanical stimulating hearing prostheses now or later developed.

The hearing prosthesis generally comprises a sound input device to receive sound waves and a vibrating transducer (e.g. actuator) hard-coupled to the sound input device and configured to vibrate in response to sound signals received by the sound input device. A housing is configured to house one or more operational components, such as a vibrating transducer and a sound input device, of the hearing prosthesis. The outer shell of the vibrator itself may also act as the housing such that the vibrator and housing are one and the same structure. Since the vibrating transducer is hard-coupled to the sound input device, feedback from the vibrating transducer received by the sound input device is more well-defined or accurate, and therefore easier to cancel out using filters or other techniques, than if the vibrating transducer was not hard-coupled to the sound input device.

Figure 1A:
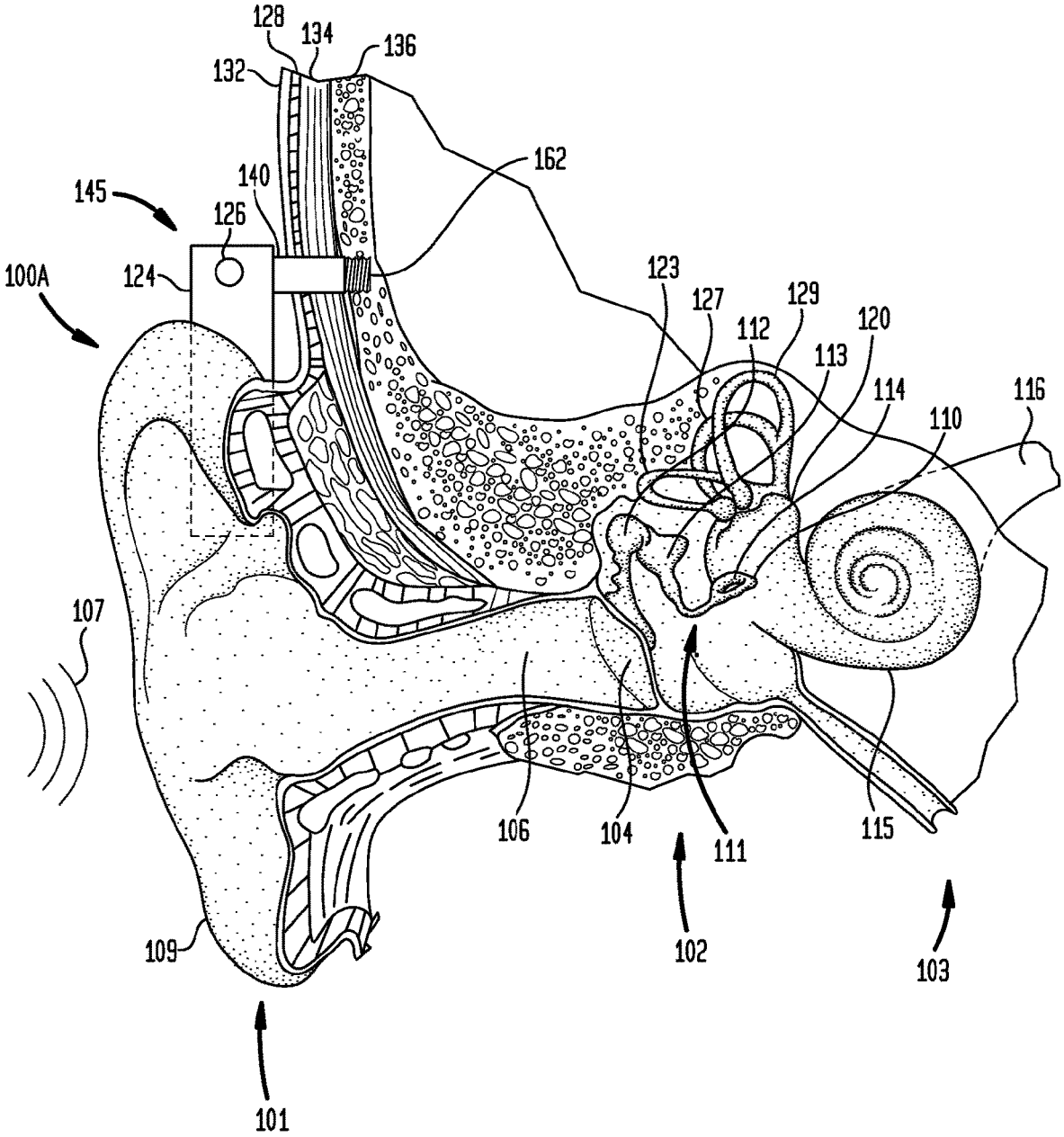
FIG. 1A illustrates a perspective view of a percutaneous bone conduction hearing prosthesis in which embodiments of the present technology may be implemented.

As noted, hearing prosthesis such as bone conduction devices have been found suitable to treat various types of hearing loss and may be suitable for individuals who cannot derive suitable benefit from acoustic hearing aids, cochlear implants, etc. FIG. 1A is a perspective view of a percutaneous bone conduction device 100A in which embodiments of the present technology may be advantageously implemented. As shown, the recipient has an outer ear 101, a middle ear 102 and an inner ear 103. Elements of outer ear 101, middle ear 102 and inner ear 103 are described below, followed by a description of bone conduction device 100A.

In a fully functional human hearing, outer ear 101 comprises an auricle 109 and an ear canal 106. A sound wave 107 is collected by auricle 109 and channeled into and through ear canal 106. Disposed across the distal end of ear canal 106 is a tympanic membrane 104 which vibrates in response to sound wave 107. This vibration is coupled to oval window or fenestra ovalis 110 through three bones of middle ear 102, collectively referred to as the ossicles 111 and comprising the malleus 112, the incus 113 and the stapes 114. Bones 112, 113 and 114 of middle ear 102 serve to filter and amplify sound wave 107, causing oval window 110 to articulate, or vibrate. Such vibration sets up waves of fluid motion within cochlea 115. Such fluid motion, in turn, activates tiny hair cells (not shown) that line the inside of cochlea 115. Activation of the hair cells causes appropriate nerve impulses to be transferred through the spiral ganglion cells and auditory nerve 116 to the brain (not shown), where they are perceived as sound.

FIG. 1A also illustrates the positioning of bone conduction device 100A relative to outer ear 101, middle ear 102 and inner ear 103 of a recipient of device 100A. As shown, bone conduction device 100A includes external component 145 which may be positioned behind outer ear 101 of the recipient and comprises a sound input device 126 to receive sound signals. Sound input device may comprise, for example, a microphone, telecoil, etc. Sound input device 126 may also be a component that receives an electronic signal indicative of sound, such as, for example, from an external audio device. For example, sound input device 126 may receive a sound signal in the form of an electrical signal from an MP3 player electronically connected to sound input device 126. As described below, sound input device may be located, for example, on the device, in the device, or on a cable extending from the device.

Also as described below, bone conduction device 100A may comprise a sound processor, a vibrating transducer and/or various other operational components which facilitate operation of the device. More particularly, bone conduction device 100A operates by converting the sound received by sound input device 126 into electrical signals. These electrical signals are utilized by the sound processor to generate control signals that cause the transducer (located in housing 124) to vibrate. These control signals are provided to the vibrating transducer. As described below, the vibrating transducer converts the signals into mechanical vibrations used to output a force for delivery to the recipient's skull.

In accordance with embodiments of the present technology, bone conduction device 100A further includes a housing 124, a coupling 140 and an implanted anchor 162 configured to attach the device to the recipient. In the specific embodiments of FIG. 1A, coupling 140 is attached to implanted anchor 162, which is implanted in the recipient. In the illustrative arrangement of FIG. 1A, implanted anchor 162 is fixed to the recipient's skull bone 136. Coupling 140 extends from implanted anchor 162 and bone 136 through muscle 134, fat 128 and skin 132 so that housing 124, or a component within housing 124, may be attached thereto. Implanted anchor 162 facilitates efficient transmission of mechanical force to the recipient. It would be appreciated that embodiments of the present technology may be implemented with other types of couplings and anchor systems.

Figure 1B:
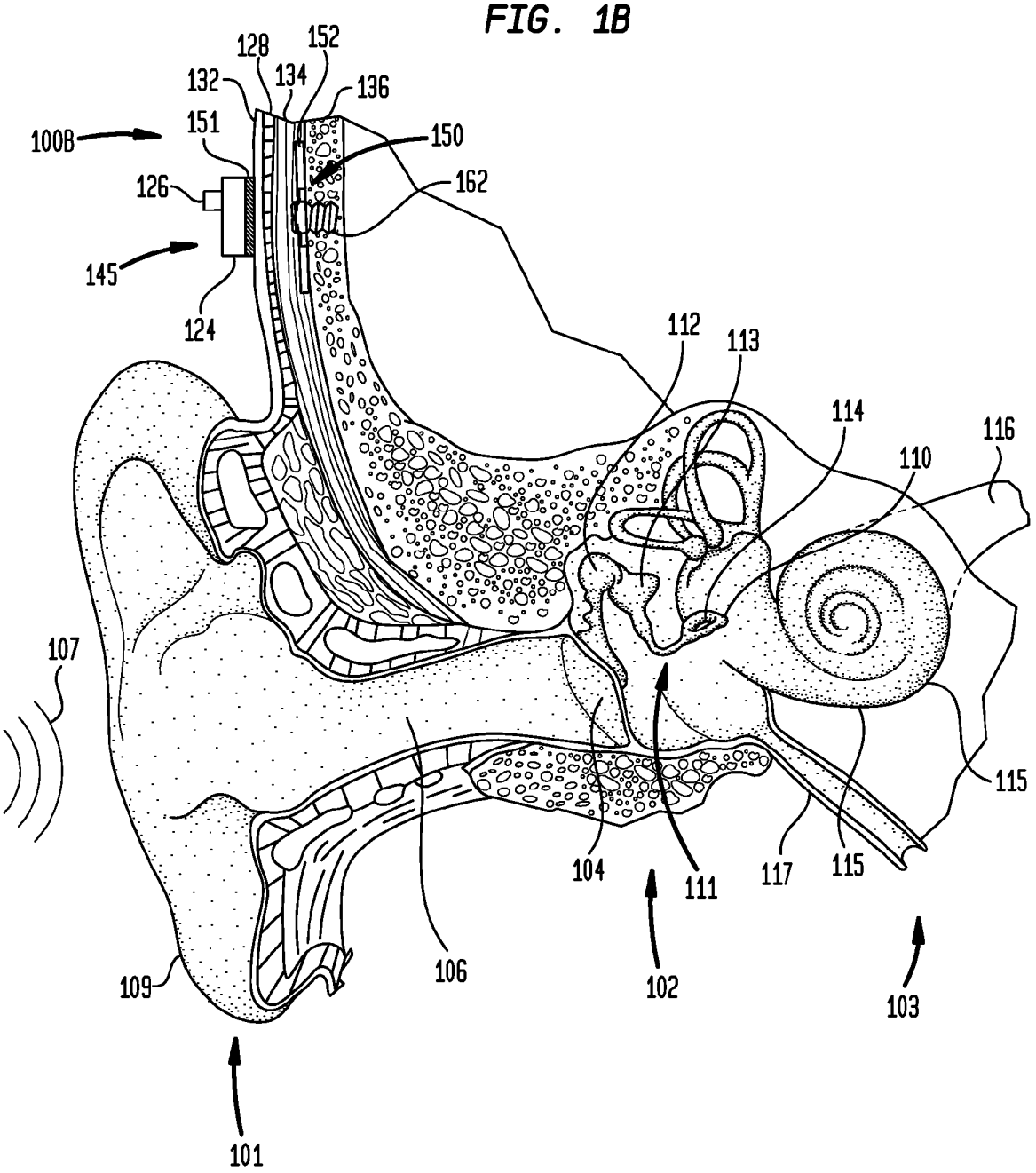
FIG. 1B illustrates a perspective view of a transcutaneous bone conduction hearing prosthesis in which embodiments of the present technology may be implemented.

FIG. 1B is a perspective view of a transcutaneous bone conduction device 100B in which embodiments of the present technology may be implemented. In the embodiments illustrated in FIG. 1B, bone conduction device 100B is positioned behind outer ear 101 of the recipient. Bone conduction device 100B comprises an external component 140 and an implantable component 150. Bone conduction device 100B includes a sound input device 126 which is hard-coupled to the vibrating transducer (not shown), as described further below.

As shown in FIG. 1B, fixation system 162 may be used to secure implantable component 150 to skull 136. As described below, fixation system 162 may be a bone screw fixed to skull 136, and also attached to implantable component 150.

In one arrangement of FIG. 1B, bone conduction device 100B is a passive transcutaneous bone conduction device. That is, no active components, such as the transducer, are implanted beneath the recipient's skin 132. In such an arrangement, the active transducer is located in external component 145. External component 145 also includes a magnetic pressure or magnetic plate 151. Implantable component 150 includes a magnetic plate 152. Magnetic plate 152 of the implantable component 150 vibrates in response to vibration transmitted through the skin from external component 145, mechanically and/or via a magnetic field, that are generated by external magnetic plate 151.

Figure 1C:
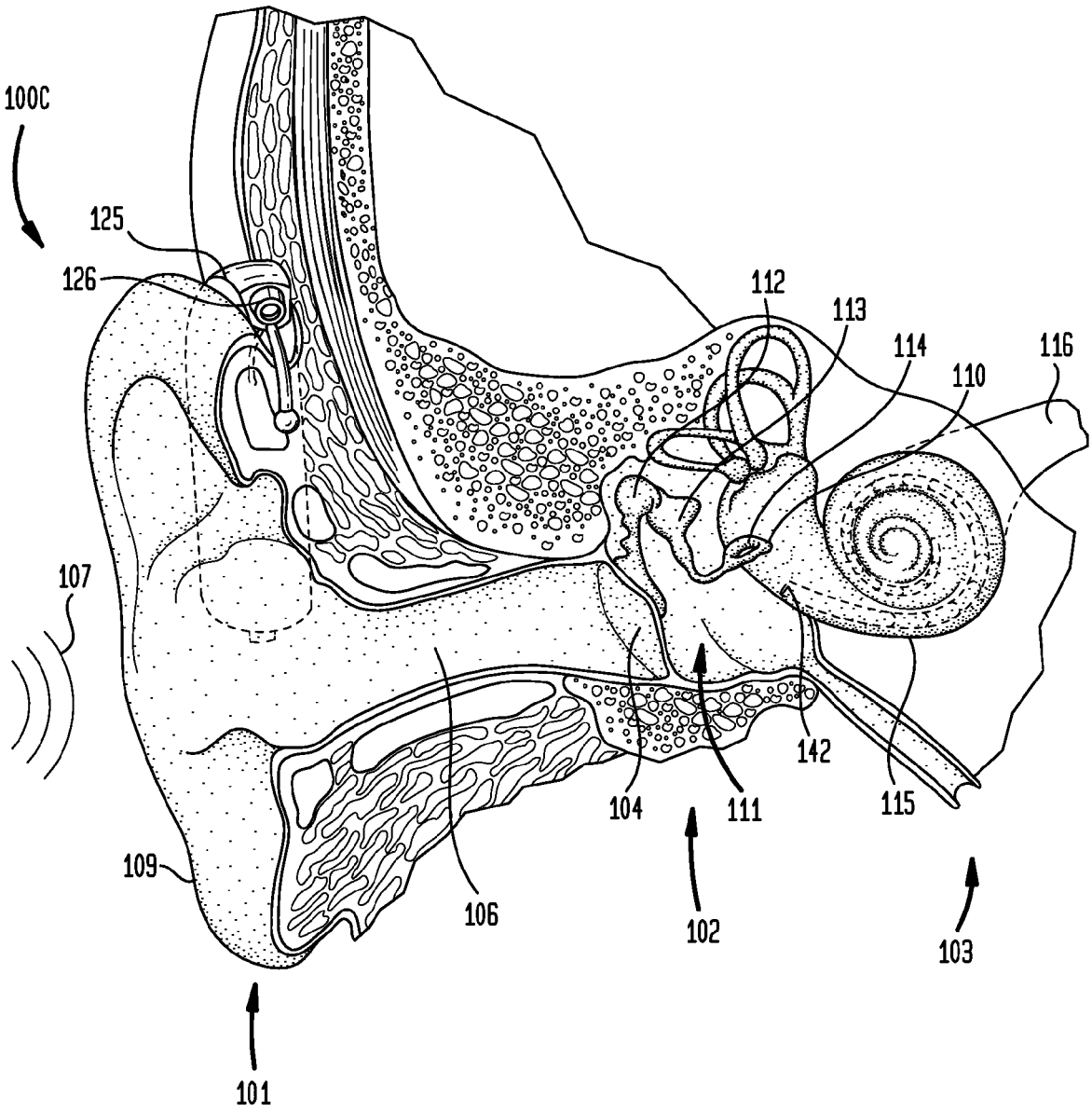
FIG. 1C illustrates a perspective view of a behind-the-ear (BTE) transcutaneous bone conduction hearing prosthesis on a recipient's head in which embodiments of the present technology may be implemented.

FIG. 1C is a perspective view of a Behind-the-Ear (BTE) transcutaneous bone conduction hearing prosthesis in which embodiments of the present technology may be implemented. As shown, bone conduction device 100C is positioned behind outer ear 101 of a recipient Bone conduction device 100C comprises a BTE 125, but no implantable component. Bone conduction device 100C includes a sound input device 126 to receive sound waves. In an exemplary embodiment, sound input device 126 may be located, for example, on or in bone conduction device 100B, or otherwise hard-coupled to the bone conduction device, as described further below. BTE 125 is affixed to skin 132 via an adhesive (not shown). BTE 125 is affixed to skin 132 at a location in which there is minimal subcutaneous fat or muscle. A vibrating transducer in the BTE generates vibrations which are transcutaneously transferred to skull bone 136, resulting in a hearing percept as described above.

Figure 2A:
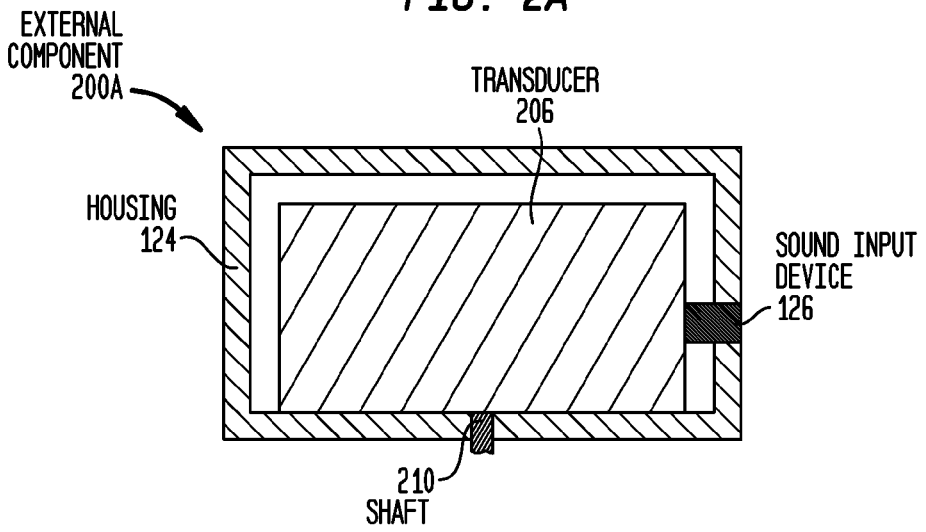
FIG. 2A illustrates a cross sectional view of an external component with a hard coupled transducer and sound input device, in which embodiments of the present technology may be implemented.

As noted, sound input device 126 and vibrating transducer 206 are rigidly connected or hard coupled to each other. Exemplary embodiments of how such a rigid connection may be implemented are illustrated in FIGS. 2A-2G. Any of FIGS. 2A-2G may be implemented in any of the hearing prostheses described with respect to FIGS. 1A-1C above. FIGS. 2A-2G are cross-sectional diagrams of embodiments of external components 200A-200G, respectively, of a bone conduction device. External Components 200 have a housing 124 in which a vibrating transducer 206 is suspended. In FIGS. 2A-2G, vibrating transducer 206 is mechanically coupled to components that facilitate the percutaneous or transcuateous transfer of vibrations to the skull. FIG. 2A is a cross sectional view of a vibrator, to be used, for example, within a bone conduction hearing prosthesis, with a directly hard-coupled transducer and sound input device, in which embodiments of the present technology may be implemented. External component 200A is a passive device because vibrating transducer 206 is located external to the recipient's body. Component 200A may also be implemented as an active device, for example implanted in a recipient's skull or within a middle ear implant. External component 200 includes housing 124. Vibrating transducer 206 is located inside housing 124. External component 200A may include a flat spring (not shown) between transducer 206 and housing 124. Sound input device 126 is located within housing 124, and more specifically at least partially within a wall of housing 124 so that sound input device 126 may have access to the air outside housing 124 to receive sound waves. Sound input device 126, however, may be located fully within housing 124 or may be located fully outside of housing 124 and connected to the outside of the housing. Vibrating transducer 206 is hard-coupled or rigidly-coupled to sound input device 126. More specifically, transducer 206 and sound input device 126 are physically and firmly connected to each other so as to allow for the direct transmission of mechanical power between transducer 206 and input device 126.

As shown in FIG. 2A, transducer 206 may be rigidly and directly coupled to sound input device 126 without any physical elements between transducer 206 and sound input device 126. In other words, transducer 206 is directly hard-coupled to sound input device 126 because it is directly connected to it, or in other words there is no other structure separating transducer 206 and sound input device 126. A directly hard-coupled transducer and sound input device, such as transducer 206 and sound input device 126 in FIG. 2A, may be beneficial because of the direct contact between the two elements without any interference elements in between. In other words, a directly hard-coupled transducer and sound input device may yield a slightly more well-defined feedback path than a device that includes intermediate elements in between hard-coupled transducer and sound input element. Since hard-coupled transducer and sound input device are directly connected, the transducer will directly transfer any present mechanical feedback directly to the sound input device. Similar benefits apply to other indirect hard-coupled systems, including those described in FIGS. 2C, 2E and 2G.

Figure 2B:
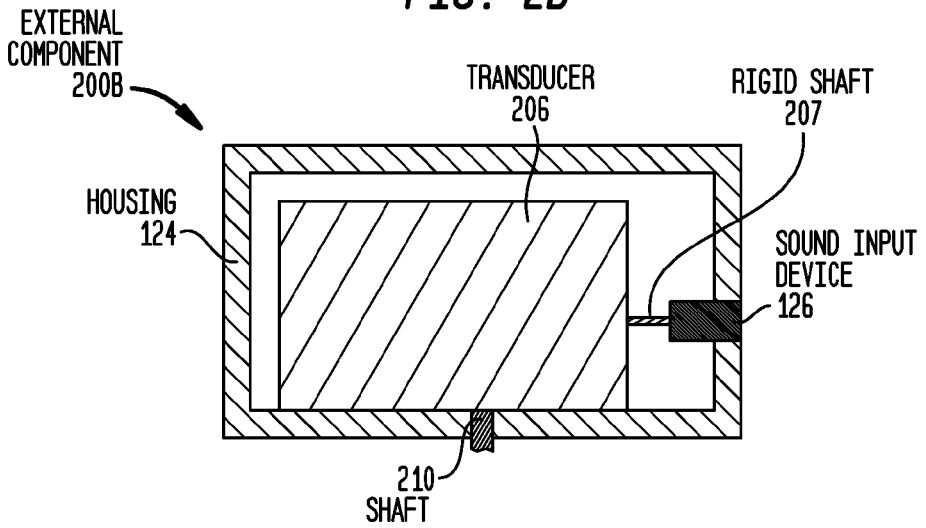
FIG. 2B illustrates a cross sectional view of an external component with an hard-coupled transducer and sound input device, in which embodiments of the present technology may be implemented.

FIG. 2B is a cross sectional view of external component 200B with an indirectly hard-coupled transducer and sound input device, in which embodiments of the present technology may be implemented. As shown in FIG. 2B, transducer 206 may be indirectly, but still rigidly, coupled to sound input device 126. More specifically, transducer 206 is coupled to sound input device 126 via rigid shaft 207. Rigid shaft 207 may be a metal post, or any other coupling mechanism that will produce a rigid connection between transducer 206 and sound input device 126. An indirect hard-coupled transducer and sound input device, such as transducer 206 and sound input device 126 in FIG. 2B, may be beneficial because it allows for more flexibility in manufacturing where different components within the system, such as transducer 206, may be placed at various places within housing 124 while still maintaining a hard-coupled connection between the transducer and sound input device. Similar benefits apply to other indirect hard-coupled systems, including that described in FIG. 2D.

Due to the rigid coupling between transducer 206 and sound input device 126, vibrations generated by transducer 206 travel through the rigid coupling to transducer 206 and input device 126. More specifically, vibrations produced by vibrating transducer 206 may be picked up by sound input device 126 as mechanical (or acoustical) feedback. Acoustic feedback heard by sound input element 126 may come from background noise, noise from the transducer movement, noise from the housing, or noise from the rigid connection between the transducer and either the sound input element or the housing due to the movement of the transducer. If vibrating transducer 206 and sound input device 126 were not rigidly coupled, and rather isolated from each other, input sound device 126 may still pick up mechanical vibrations (and/or acoustic signals) as feedback from transducer 206. However, such mechanical feedback may be unpredictable and/or varying because of the physical and electrical space separation between transducer 206 and sound input device 126. Rigid coupling between transducer 206 and sound input device 126, however, causes the mechanical feedback received by sound input device 126 from transducer 206 to be well-defined. While the mechanical feedback received by sound input device 126 from transducer 206 may be stronger or of a higher magnitude, the feedback is more predictable and substantially constant. In one form the feedback is easily determinable or calculable based on one or more factors such as voltage applied to the transducer or other known measurable factors.

Mechanical feedback, as described, is well-defined or well known when it is set or measured during development of the hearing prosthesis or during the fitting process of the hearing process to the recipient. In other words, the mechanical feedback path is determinable and the feedback will not vary far from that determined feedback because the mechanics of the system, due to the rigid connection, will not vary over time. More specifically, the mechanics of the system, including the rigid coupling, should not change over time even if the transducer and/or other components of the system are shaken, dropped, or normal use events. As such, the set/measured feedback data taken during manufacture or fitting will remain consistent. This concept may be most reliable for lower frequencies, e.g. frequencies below 1 kHz, which are the most common frequencies for the mechanical feedback discussed herein, but may also apply to higher frequencies. On the other hand, prior art systems describe the opposite principle. More specifically, prior art describes systems that isolate the sound input device and insulate the sound input device from the actuator to try to reduce the feedback reaching the sound input device as low as possible.

A well-defined feedback path, such as the feedback from a transducer rigidly coupled to a sound input device, is more easily canceled by a filter or set of filters or other noise cancelling technique because the mechanical feedback is not random and can be accurately defined/predicted, as described. For example, such feedback may be canceled by the use of a static or slow moving filter, such as, for example, an all pass filter. However, it is understood that various other techniques for canceling such feedback may be used, such as other types of filters and anti-feedback algorithms.

Vibrating transducer 206 is also coupled to shaft or post 210. Shaft 210 may be connected to an anchor or abutment to be implanted in the skull of a recipient as part of a percutaneous bone conduction device, as shown in FIG. 1A. Shaft 210 may be connected to a plate as part of a transcutaneous bone conduction device, as shown in FIG. 1B. The plate may be in the form of a permanent magnet and/or in another form that generates and/or is reactive to a magnetic field, or otherwise permits the establishment of magnetic attraction between the external device 200 and an implantable component in the recipient's skull sufficient to hold the external device 200 against the skin of the recipient. If vibrating transducer 206 were mechanically coupled to such a plate, the vibrations from transducer 206 are transferred from the actuator to the plate and to the recipient's skull.

Figure 2C:
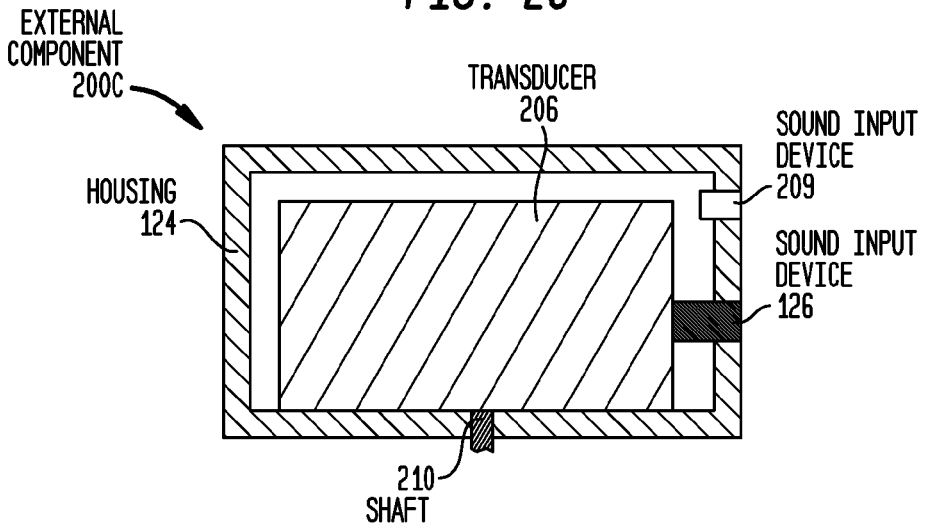
FIG. 2C illustrates a cross sectional view of an external component with an hard-coupled transducer and two sound input devices, in which embodiments of the present technology may be implemented.

FIG. 2C is a cross sectional view of an external component 200C with a hard-coupled transducer and two sound input devices, in which embodiments of the present technology may be implemented. A second input device may be added to the embodiments illustrated in FIGS. 2A and 2B, such as sound input device 209. Sound input device 209 is located within housing 124, and more specifically at least partially within a wall of housing 124 so that sound input device 209 may have access to the air outside housing 124 to receive sound waves. Sound input device 209, however, may be located fully within housing 124 or may be located fully outside of housing 124 and connected to the outside of the housing.

Figure 2D:
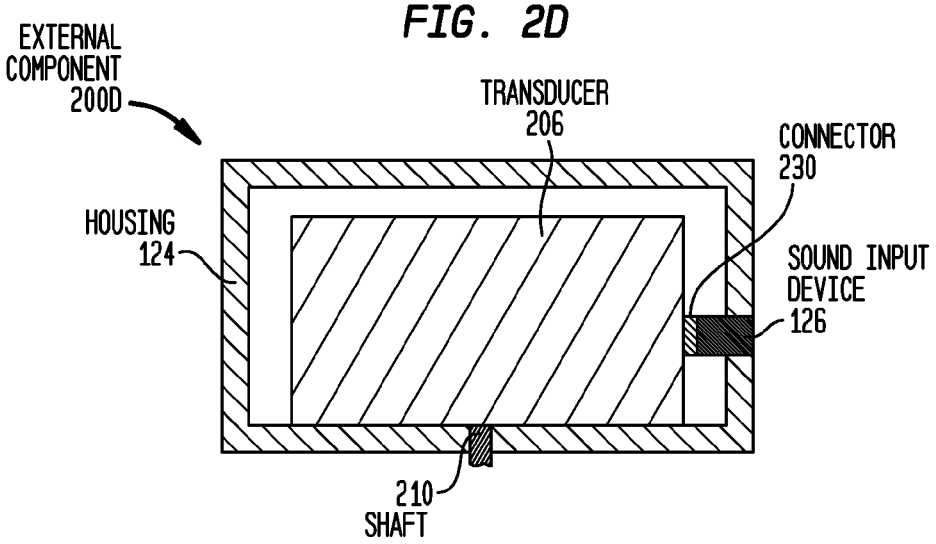
FIG. 2D illustrates a cross sectional view of an external component with a hard-coupled transducer and sound input device coupled via a connector, in which embodiments of the present technology may be implemented.

FIG. 2D is a cross sectional view of an external component 200D with a hard-coupled transducer and sound input device coupled via a connector, in which embodiments of the present technology may be implemented. As shown in FIG. 2D, transducer 206 may be indirectly, but still rigidly, coupled to sound input device 126. More specifically, transducer 206 is coupled to sound input device 126 via connector 230. Connector 230 may be glue, solder, a printed circuit board (PCB), or any other layer or component that will produce a rigid connection between transducer 206 and sound input device 126. It is appreciated that while connector 230 is shown in FIG. 2D as spanning the width of sound input device 126, it may also extend to other portions of transducer 206.

Figure 2E:
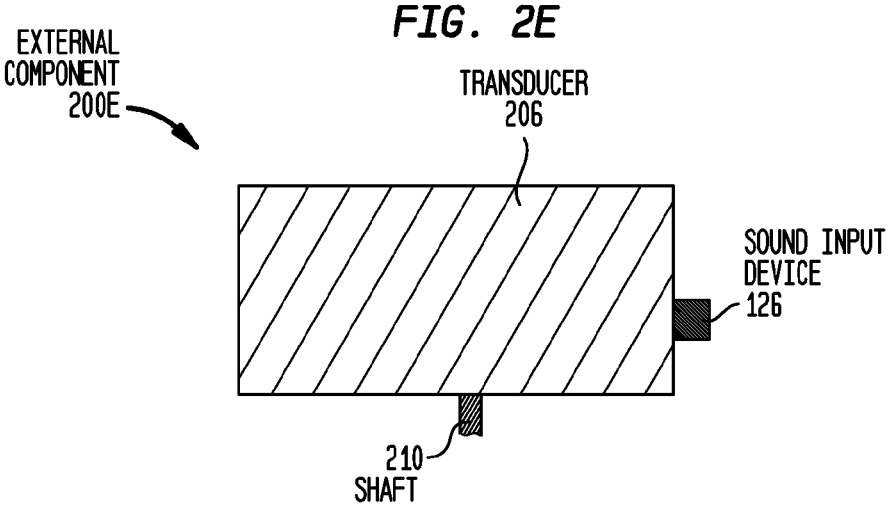
FIG. 2E illustrates a cross sectional view of an external component with a hard-coupled transducer and sound input device where the outer shell of the transducer acts as the housing, in which embodiments of the present technology may be implemented.

FIG. 2E is a cross sectional view of external component 200E with a directly hard-coupled transducer and sound input device where the outer shell of the vibrating transducer itself acts as the housing (such that the vibrating transducer and housing are one and the same structure), in which embodiments of the present technology may be implemented. Device 200E is a passive transcutaneous bone conduction device because vibrating transducer 206 is located external to the recipient's body. External device 200E includes vibrating transducer 206 and sound input device 126. Vibrating transducer 206 is hard or rigidly coupled to sound input device 126. More specifically, transducer 206 and sound input device 126 are physically and firmly connected to each other so as to allow for the direct transmission of mechanical power between transducer 206 and input device 126. As shown in FIG. 2E, transducer 206 may be rigidly and directly coupled to sound input device 126 without any physical elements between transducer 206 and sound input device 126. However, as shown in FIGS. 2B and 2D, for example, a rigid shaft or other connector may physically connect transducer 206 to sound input device 126, which may be integrated into FIG. 2E. Furthermore, as shown in FIG. 2C, additional sound input devices may be utilized.

Figure 2F:
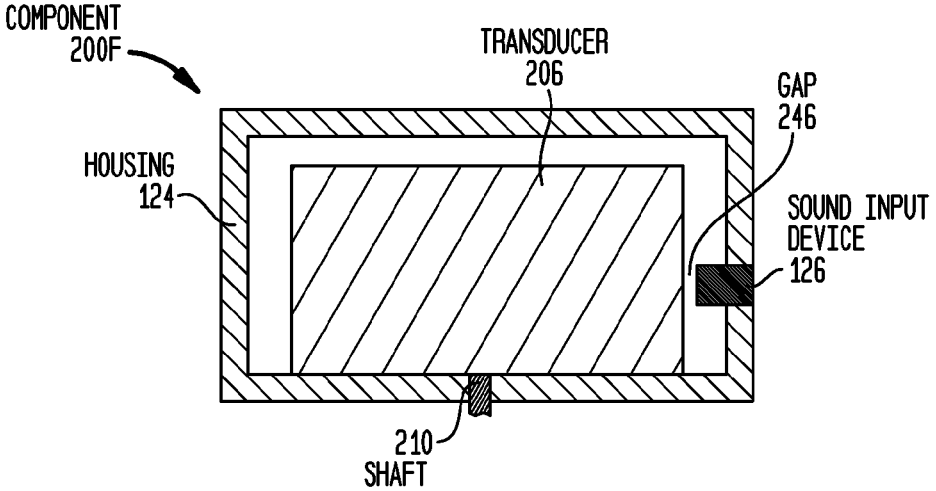
FIG. 2F illustrates a cross sectional view of external component with an indirectly hard-coupled transducer and sound input device, in which embodiments of the present technology may be implemented.

FIG. 2F is a cross sectional view of external component 200F with an indirectly hard-coupled transducer and sound input device, in which embodiments of the present technology may be implemented. As shown in FIG. 2F, transducer 206 may be indirectly, but still rigidly, coupled to sound input device 126. More specifically, transducer 206 is coupled to sound input device 126 via housing 124. Gap 246, which is a gap between transducer 206 and sound input device 126, shows that transducer is not directly coupled to sound input device 126. Gap 246 should be large enough such that transducer 206 and sound input device 126 do not touch while transducer 206 is vibrating. Rigid coupling between transducer 206 and sound input device 126, even if not due to direct rigid coupling between transducer 206 and sound input device 126 or rigid coupling via a third component, as shown in other embodiments of the present technology, may cause the mechanical feedback received by sound input device 126 from transducer 206 to be well-defined. An indirect hard-coupled transducer and sound input device, such as transducer 206 and sound input device 126 in FIG. 2F, may be beneficial because, in addition to those benefits described with respect to FIG. 2B, no additional components are required to hard-couple transducer 206 to sound input device 126 besides housing 206. A system that does not use such extra components helps to conserve resources and manufacturing complexity.

Figure 2G:
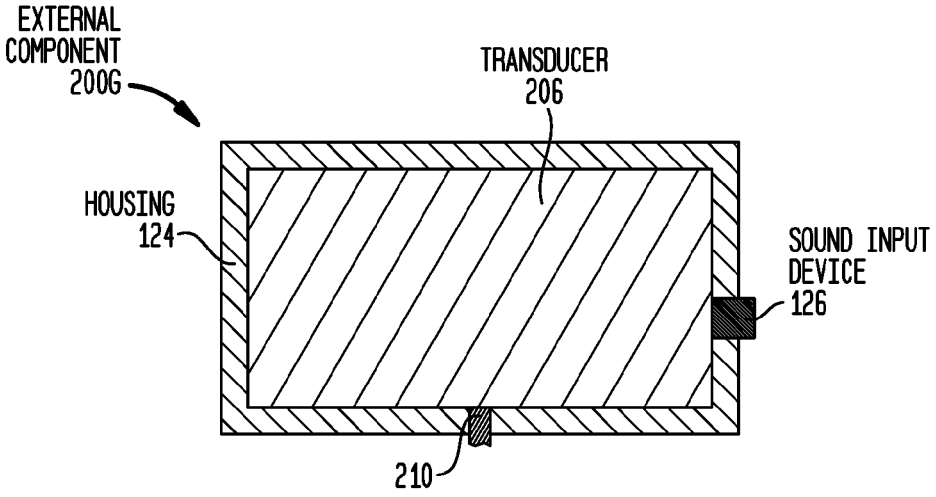
FIG. 2G illustrates a cross sectional view of external component with an indirectly hard-coupled transducer and sound input device, in which embodiments of the present technology may be implemented.

FIG. 2G is a cross sectional view of external component 200G with an indirectly hard-coupled transducer and sound input device, in which embodiments of the present technology may be implemented. External component 200G is similar to external component 200A in that vibrating transducer 206 is directly hard-coupled or rigidly-coupled to sound input device 126. However, as shown in FIG. 2G, housing 124 is secured around each edge of transducer 206 such that there is no space between housing 124 and transducer 206.

Embodiments of the present technology may also be implemented in a middle ear implant, or direct mechanical stimulation system. Such an embodiment may be implemented with similar features as explained in FIG. 2, but implanted deeper into a recipient's auditory pathways.

Figure 3A:
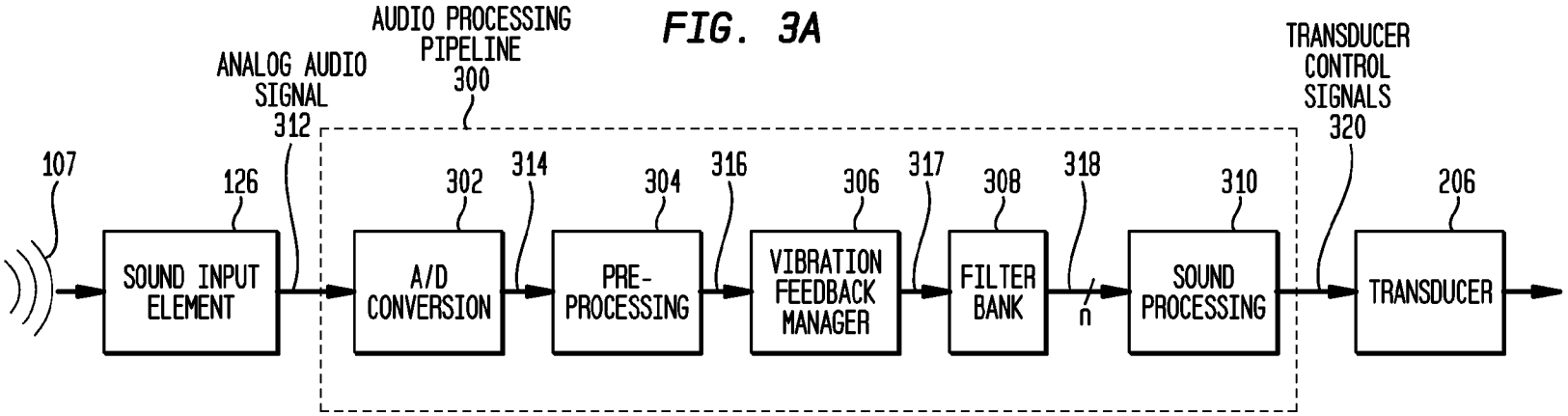
FIG. 3A illustrates a processing pipeline by which embodiments of the present technology may be implemented.

FIG. 3A is an audio processing pipeline 300 which may be implemented in a bone conduction device having a rigidly coupled microphone and transducer, as described above. Audio processing pipeline 300 receives analog audio signals 312 generated by sound input device 126, and generates control signals 320 for controlling the operation of the vibrating transducer 206.

Initially, analog-to-digital conversion operations are performed on analog audio signal 312 at block 302. The A/D conversion encodes analog audio signal 312 at a specified sample rate, then further scales the encoded signal, prior to generating a digital audio signal 314 representative of the received sound 107.

Pre-processing block 304 receives digital audio signal 314 and generates one or more pre-processed digital signals to provide to vibration feedback manager 306. Examples of operations that can be performed by pre-processing block 304 include various types of signal conditioning, multi-channel compression, dynamic range expansion, noise reduction and/or amplitude scaling.

Pre-processed digital audio signal 316 may contain noise from any one of a variety of sources. For example, the feedback of transducer vibrations through sound input device 126 will result in signal 316 having noise which could interfere with the fidelity of the hearing percept invoked by the hearing prosthesis. As shown in FIG. 3A, a Vibration Feedback Manager 306 filters such noise from digital audio signal 316. As noted, because vibrating transducer 306 and sound input device 126 are rigidly coupled to each other, the mechanical feedback received by sound input device 126 from transducer 306 is predictable and substantially constant, a condition referred to herein as being well-defined. Such feedback is effectively canceled by Vibration Feedback Manager 306.

Filter bank 308 separates pre-processed digital signals 317 into a plurality of frequency bands for processing by sound processing block 310.

Filtered digital signals 318 are provided from filter bank 308 to sound processing block 310. Sound processing 310 may include applying digital signal processing algorithms to generate transducer control signals 320. Therefore, control signals 320 will be a signal capable of being understood by transducer 206 to drive the transducer to generate a mechanical force representative of the received sound. The output signal of sound processing block 310 will represent generated stimulation information based on the processed signals.

Figure 3B:
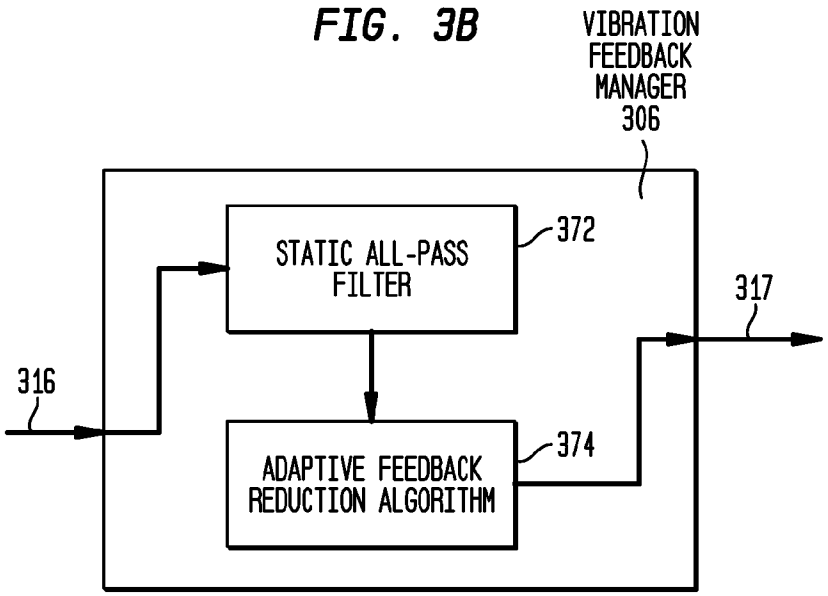
FIG. 3B illustrates a filtering bank feedback manager processing pipeline by which embodiments of the present technology may be implemented.

FIG. 3B is a functional block diagram of vibration feedback manager 306 illustrated in FIG. 3A. In the illustrative embodiment, Vibration Feedback Manager 306 has two filters that sequentially process digital audio signal 316: a static all-pass filter 372 that processes digital audio signal 316, followed by an adaptive feedback reduction algorithm 374 that further processes the signal.

Static filter 372 may be, for example, a wholly static or slow moving all-pass filter, such as an all pass filter with a static phase shift. However, a variety of other filters may be used, including but not limited to an IIR filter, an all-pass phase equalizer filter or an FIR filter. Filter 372 is used to cancel out at least the mechanical feedback received by sound input device 126 (and other sound input devices, such as sound input device 309, if present) picked up from vibrations by transducer 306. Such mechanical feedback is generally at relatively lower frequencies, for example frequencies less than 1 kHz, but may also have higher frequency components. Furthermore, the feedback received by vibration feedback manager 306 generally comprises mechanical feedback, but may also comprise acoustical feedback received from transducer 206 or from other sources.

As noted, vibration feedback manager 306 also includes an adaptive feedback reduction algorithm 374. Filtered signal(s) from filter 372 are passed to filter(s) 374, which applies an adaptive feedback reduction algorithm to remove changes in the feedback path as well as any acoustical feedback (generally at higher frequencies) that filter 372 did not cancel out. Filter 374, for example, may be implemented into the system using software, a digital circuit, an analog circuit, or other implementations not described herein. For example, vibration feedback manager 306 may include a microprocessor or other signal processor device that executes filter 374. After adaptive feedback reduction algorithm 374 is applied to the signal(s), signal 317 is sent out of the vibration feedback manager 306 and to the next step in processing pipeline 300.

As noted, filter 372 may be static. Alternatively, filter 372 may be slow-moving and therefore not completely static. Because the mechanical feedback received by a microphone from the transducer is relatively consistent, and therefore, predictable, filter 372 may be selected in production based on measurements of the feedback.

However, even well-defined feedback may adjust or vary slightly over time due to, for example, aging of the device, changes in vibrating transducer load, or physical environment, such as the recipient covering the bone conduction device. Therefore, in the illustrative embodiment, adaptive feedback reduction algorithm 374 may dynamically adjust the filter system based on changes in the feedback over time. Adaptive feedback reduction algorithm 374 may compare the signal(s) received by the sound input devices with the feedback signals that are being transmitted by the vibrating transducer to determine any changes in the feedback. Vibration feedback manager 306 and, more specifically, filter 374 may use this feedback information to adjust itself over time. However, because mechanical feedback received by a microphone from a hard-coupled transducer may be so well-defined, system adaptation may be set to occur at a rate as low as 160 milliseconds, or even slower. For example, the speed of system adaptation may be set to directly correlate to frequency of the feedback, i.e. the lower the frequency, the lower the adaptation time of the system.

Vibration feedback manager 306 may dynamically adjust the filtering system dynamically, as described above, or feedback changes may also be noted and accounted for by an audiologist fitting a recipient.

As noted, filter 372 generally cancels feedback at lower frequencies. However, filter 372 may cancel some feedback at higher frequencies. Furthermore, as noted, adaptive feedback reduction algorithm 374 generally cancels feedback at higher frequencies. However, adaptive feedback reduction algorithm 374 may also cancel other feedback that was not canceled at filter 372, such as, for example, some lower frequency feedback.

Figure 4A:
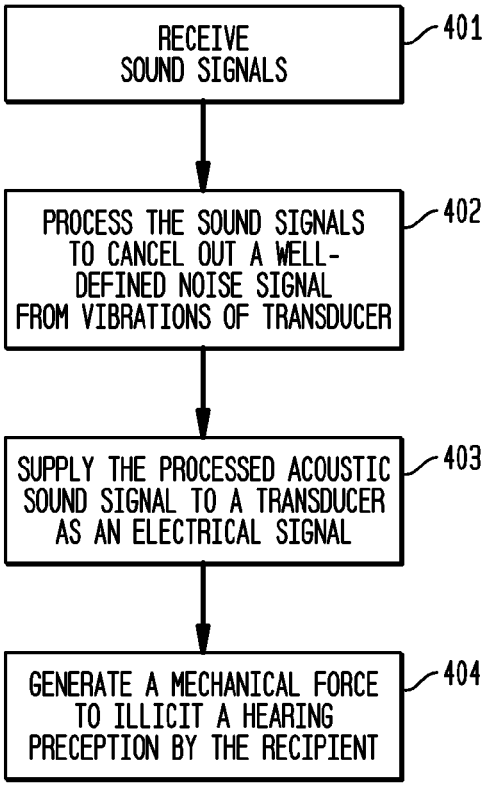
FIG. 4A illustrates a flow chart in which embodiments of the present technology may be implemented.
Figure 4B:
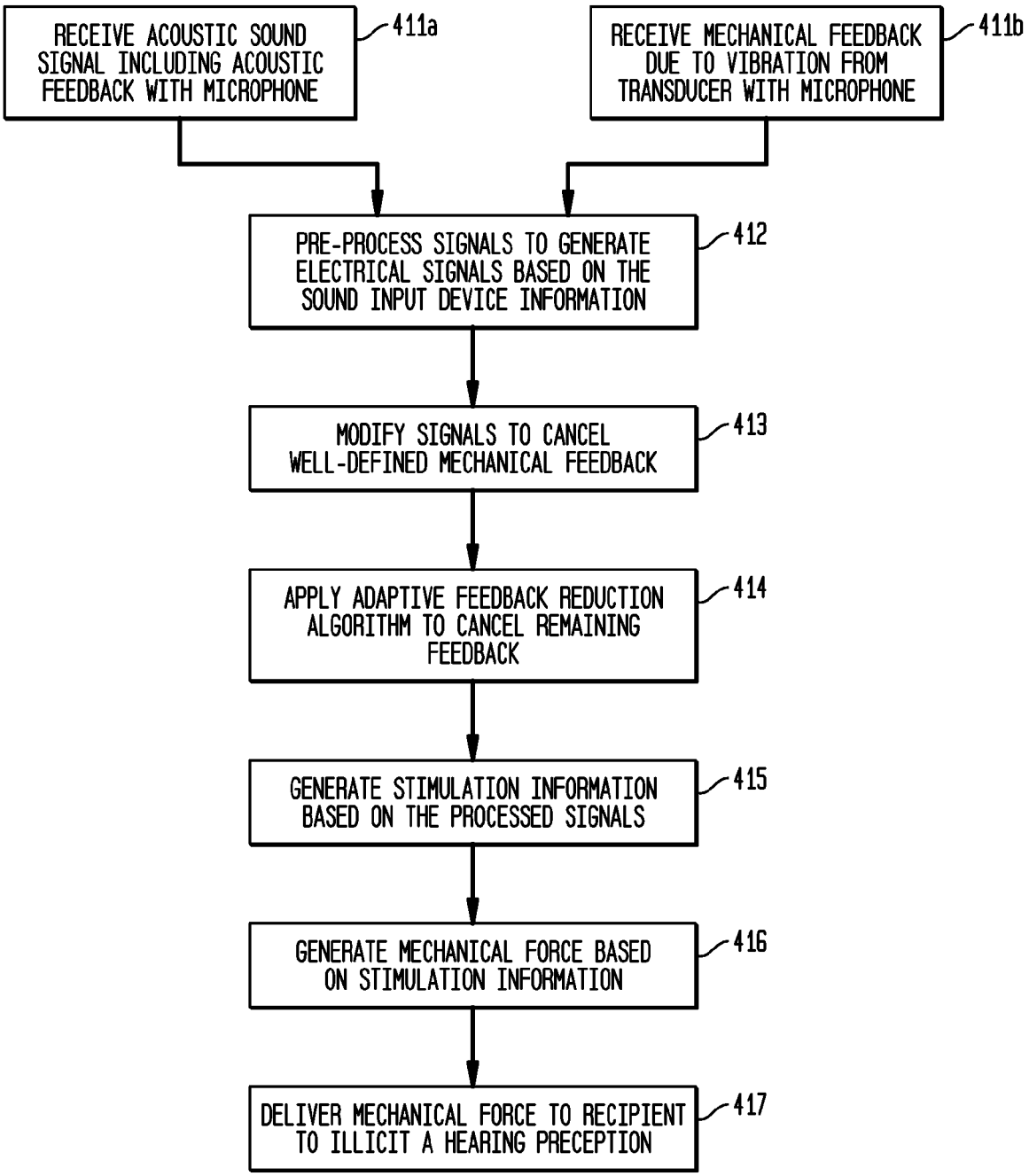
FIG. 4B illustrates a flow chart in which embodiments of the present technology may be implemented.

FIGS. 4A and 4B are flow charts showing methods by which embodiments of the present technology may be implemented. More specifically, FIGS. 4A and 4B illustrate the general procedure by which one or more sound signals are treated when received by sound input device 126. As noted in block 401, sound is received by the system at sound input device 126 (or other sound input devices, such as sound input device 209, if present). As noted in block 402, the inputted sound signals are then processed to, for example, filter out any feedback or noise present in the signals. For example, this feedback may include well-defined feedback from vibrations of transducer 206. As noted, this feedback is well-defined because, for example, sound input device 126 is hard-coupled to transducer 206.

As noted in block 403, the processed and filtered signals are then passed to the transducer as control/driver signals. As noted in block 404, the signals passed to the transducer are used to generate a mechanical force to illicit a hearing perception by the recipient. As noted, the mechanical force generated by transducer 206 will be transmitted to the skull bone of the recipient by one or more of several methods of bone conduction. For example, as shown in FIG. 2, mechanical force may be transferred to the skull bone of the recipient via percutaneous bone conduction or transcutaneous bond conduction. Transcutaneous bond conduction may utilize magnetic plates (one implantable and one external) or may adhere the bone conduction device to the side of the recipient's head near the skull bone of the recipient.

FIG. 4B is a more detailed flow chart showing a method by which embodiments of the present technology may be implemented. As noted in blocks 411*a* and 411*b*, signals received by the bone conduction devices according to embodiments of the present technology may be in the form of, for example, acoustic sound, which may include acoustic feedback, or mechanical feedback. As noted, the source of the acoustic feedback heard the sound input element may be from background noise, noise from the transducer movement, noise from the housing, or the rigid connection. As noted in block 412, whichever signals are received by the system at sound input device 126 (or other input devices, if present) are pre-processed to generate electrical signals based on the information received by the sound input device(s). The signals are processed to, for example, turn the analog signals received by the microphone(s) into digital signals.

As noted in block 413, the digital signals received from pre-processing are then modified to, for example, cancel the well-defined mechanical feedback received as a result of the transducer's vibrations. As noted, this well-defined feedback may be canceled using a static or slow-moving all-pass filter or other canceling devices. However, other noise signals or feedback may be canceled due to this static or slow-moving filter other than the feedback received from the vibrating transducer. If feedback is left over (likely mostly acoustic feedback) after such a filter is applied, that feedback will be canceled by an adaptive feedback reduction algorithm, as noted in block 414.

After the digital signals are filtered, the system generates stimulation information based on the processed and filtered signals to generate a mechanical force based on that stimulation information, as noted in blocks 415 and 416, respectively. When stimulation information based on a processed audio signal is sent to the transducer, the transducer generates a mechanical force based on that information and the mechanical force is delivered to the recipient to illicit a hearing perception, as noted in block 417. As noted above and as shown in FIGS. 1 and 2, the mechanical force may be transferred to the skull bone of the recipient via different types of bone conduction hearing prostheses.

The technology described and claimed herein is not to be limited in scope by the specific preferred embodiments herein disclosed, since these embodiments are intended as illustrations, and not limitations, of several aspects of the technology. Any equivalent embodiments are intended to be within the scope of this technology. Indeed, various modifications of the technology in addition to those shown and described herein will become apparent to those skilled in the art from the foregoing description. Such modifications are also intended to fall within the scope of the appended claims.

What is claimed is:

1. A hearing prosthesis, comprising:

at least one sound input device configured to sense a sound signal; and a transducer configured to generate a vibration based on the sound signal, wherein the sound input device is substantially rigidly coupled to the transducer, wherein the hearing prosthesis includes a housing in which the transducer is housed, and wherein the housing is part of a removable component of a percutaneous bone conduction device or a passive transcutaneous bone conduction device.

2. The hearing prosthesis of claim 1, further comprising a signal processor configured to filter mechanical feedback from vibration received by the sound input device, wherein the signal processor filters mechanical feedback using an all-pass filter.

3. The hearing prosthesis of claim 2, wherein the all-pass filter is static.

4. The hearing prosthesis of claim 2, wherein the all-pass filter is slow moving.

5. The hearing prosthesis of claim 1, further comprising a two part feedback management system, wherein a first part of the two part feedback management system is configured to reduce low frequency feedback.

6. The hearing prosthesis of claim 5, wherein a second part of the two part feedback management system is configured to reduce high frequency feedback.

7. The hearing prosthesis of claim 6, wherein adaptation of the first part of the two part feedback management system by the second part is configured to update less than about once every 200 milliseconds.

8. The hearing prosthesis of claim 1, further comprising a rigid connector coupled to the transducer and coupled to the sound input device.

9. The hearing prosthesis of claim 1, further comprising a second sound input device, wherein the second sound input device is rigidly coupled to the transducer.

10. The hearing prosthesis of claim 1, wherein the transducer and the housing are one and the same.

11. The hearing prosthesis of claim 1, wherein the transducer is configured to directly transfer feedback into the sound input device.

12. The hearing prosthesis of claim 1, wherein the hearing prosthesis is configured such that a mechanical feedback path from the transducer to the sound input device is a well-defined feedback path.

13. The hearing prosthesis of claim 1, wherein the transducer is configured to indirectly transfer feedback into the sound input device.

14. The hearing prosthesis of claim 1, further comprising a means for managing vibration feedback.

15. The hearing prosthesis of claim 1, further comprising a static all-pass filter that processes a digital audio signal and an adaptive feedback reduction algorithm that further processes the signal from the static all-pass filter.

16. The hearing prosthesis of claim 1, wherein the hearing prosthesis includes only one main housing corresponding to the housing in which the transducer is housed, and wherein the transducer is a vibrating transducer of a bone conduction device, and wherein the housing directly supports the sound input device.

17. The hearing prosthesis of claim 1, wherein the housing is part of the removable component of the percutaneous bone conduction device.

18. The hearing prosthesis of claim 1, wherein the entirety of the transducer is located in the housing, and wherein the sound input device is directly supported by the housing.

19. The hearing prosthesis of claim 1, wherein the hearing prosthesis is configured to directly transfer any present mechanical feedback directly to the sound input device.

20. The hearing prosthesis of claim 1, further comprising a means for purposely channeling feedback into the sound input device from the transducer.

21. The hearing prosthesis of claim 1, wherein the housing is part of the removable component of the passive transcutaneous bone conduction device.

22. A hearing prosthesis, comprising:

at least one sound input device configured to sense a sound signal;

a transducer configured to generate a vibration based on the sound signal; and a signal processor connected to the sound input device and configured to filter well-defined mechanical feedback from vibration received by the sound input device, wherein the hearing prosthesis includes a housing in which the transducer is housed, and wherein the housing is part of a removable component of a percutaneous bone conduction device or a passive transcutaneous bone conduction device.

23. The hearing prosthesis of claim 22, wherein the signal processor is configured to filter the well-defined mechanical feedback using an all-pass filter.

24. The hearing prosthesis of claim 22, wherein the signal processor is configured to filter the well-defined mechanical feedback using an anti-phase filter or an IIR filter.

25. The hearing prosthesis of claim 22, wherein the signal processor is configured to filter the well-defined mechanical feedback at frequencies below 1 kHz.

26. The hearing prosthesis of claim 22, wherein the transducer and sound input device are rigidly coupled to each other.

27. The hearing prosthesis of claim 22, wherein the signal processor is part of an audio processing pipeline extending from the at least one sound input device to the transducer.

28. The hearing prosthesis of claim 22, wherein the signal processor is part of an audio path that has only one input opening.

29. The hearing prosthesis of claim 22, wherein the signal processor is part of an audio path extending from the at least one sound input device to the transducer, the path only having an input at the sound input device.

30. The hearing prosthesis of claim 22, wherein the signal processor is part of an audio path that comprises a plurality of functional components, wherein the functional components of the audio path other than the sound input device receive input from only the prior functional component in an unmodified manner.

31. The hearing prosthesis of claim 22, wherein the hearing prosthesis is configured to directly transfer output from the transducer into the sound input device.

32. The hearing prosthesis of claim 22, wherein the transducer is a vibrator of the bone conduction device.

33. The hearing prosthesis of claim 22, wherein the transducer is a means for generating bone conduction vibrations to evoke a bone conduction hearing percept via percutaneous bone conduction.

34. The hearing prosthesis of claim 22, wherein the signal processor is part of an audio path that has only one input opening, and wherein there is no input opening in the audio path between the input opening and the signal processor.

35. The hearing prosthesis of claim 22, wherein the housing is part of the removable component of the percutaneous bone conduction device.

36. The hearing prosthesis of claim 22, wherein the hearing prosthesis is configured such that the structure of the hearing prosthesis provides the well-defined mechanical feedback from the transducer to the sound input device.

37. The hearing prosthesis of claim 22, wherein the housing is part of the passive transcutaneous bone conduction device.

38. A method, comprising:

receiving an acoustic signal with acoustic feedback and mechanical feedback;

applying a first modification of the signal to reduce well-defined mechanical feedback from the signal;

generating stimulation information based on the modified signal; and generating a mechanical force based on the stimulation information, wherein the action of generating is executed with a hearing prosthesis that includes a housing in which a transducer that generated the stimulation is housed, and wherein the housing is part of a removable component of a percutaneous bone conduction device or a passive transcutaneous bone conduction device.

39. The method of claim 38, further comprising applying a second modification of the signal to reduce feedback remaining in the signal after the first modification is applied.

40. The method of claim 38, wherein applying the first modification is optimized to reduce low frequency feedback.

41. The method of claim 39, wherein applying the second modification is optimized to reduce high frequency feedback.

42. The method of claim 39, wherein applying the second modification comprises applying an adaptive feedback reduction algorithm, and wherein applying the adaptive feedback reduction algorithm comprises updating less than about once every 200 milliseconds.

43. The method of claim 38, wherein the method is executed such that the only feedback is the acoustic feedback and the mechanical feedback.

44. The method of claim 38, further comprising, prior to applying the first modification of the signal, obtaining feedback data during a manufacturing process of the prosthesis and/or a fitting process of the prosthesis to a recipient, wherein the applied first modification of the signal is based on the obtained feedback data.

45. The method of claim 38, wherein the housing is part of the removable component of the percutaneous bone conduction device.

46. The method of claim 38, wherein the housing is part of the passive transcutaneous bone conduction device.

* * * * *